United States Patent [19]

Beneke et al.

[11] 4,365,389

[45] Dec. 28, 1982

[54] APPARATUS FOR CLEANING TEXTILE FIBER TUFTS

[75] Inventors: Wolfgang Beneke, Mönchen-Gladbach; Ferdinand Leifeld, Kempen, both of Fed. Rep. of Germany

[73] Assignee: Trützschler GmbH & Co. KG, Mönchen-Gladbach, Fed. Rep. of Germany

[21] Appl. No.: 196,108

[22] Filed: Sep. 29, 1980

[30] Foreign Application Priority Data

Sep. 25, 1979 [DE] Fed. Rep. of Germany ..... 2939640
Aug. 22, 1980 [DE] Fed. Rep. of Germany ..... 3031632

[51] Int. Cl.[3] ..... D01B 1/00

[52] U.S. Cl. ..... 19/200; 19/205; 209/145

[58] Field of Search ..... 19/200, 202, 204, 205, 19/107; 209/145

[56] References Cited

U.S. PATENT DOCUMENTS

| | | | |
|---|---|---|---|
| 1,023,750 | 4/1912 | Morschep | 209/145 X |
| 1,128,758 | 2/1915 | Cheesman | 19/205 |
| 1,593,965 | 7/1926 | Cobb | 19/200 X |
| 1,942,868 | 1/1934 | Mitchell | 19/204 X |
| 2,025,701 | 12/1935 | Mitchell | 19/202 X |
| 3,096,276 | 7/1963 | Franks et al. | 19/200 X |
| 3,435,484 | 4/1969 | Langdon | 19/205 X |

FOREIGN PATENT DOCUMENTS

| | | | |
|---|---|---|---|
| 1286436 | 1/1969 | Fed. Rep. of Germany . | |
| 1127176 | 9/1968 | United Kingdom | 19/200 |

*Primary Examiner*—Louis Rimrodt
*Attorney, Agent, or Firm*—Spencer & Kaye

[57] ABSTRACT

In apparatus for cleaning and removing dust from textile fiber tufts, which apparatus includes a channel for the passage of fiber tufts and including a member for introducing air into the channel, components defining an air separation zone having apertures and associated with the channel for separating air from the tufts in the channel, and a device for extracting air from the air separation zone, the components defining the air separation zone include at least one comb disposed a short distance downstream of the air introducing member at a location to enable tufts being carried through the channel to abut on the comb. An abutment member can additionally be disposed in the channel in the vicinity of the upstream end of the comb to aid in releasing dirt from the tufts.

35 Claims, 9 Drawing Figures

FIG. 5
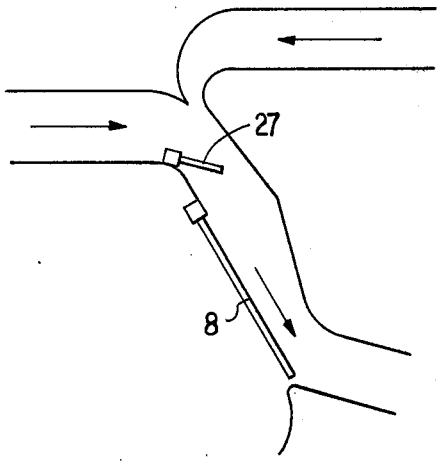
FIG. 6
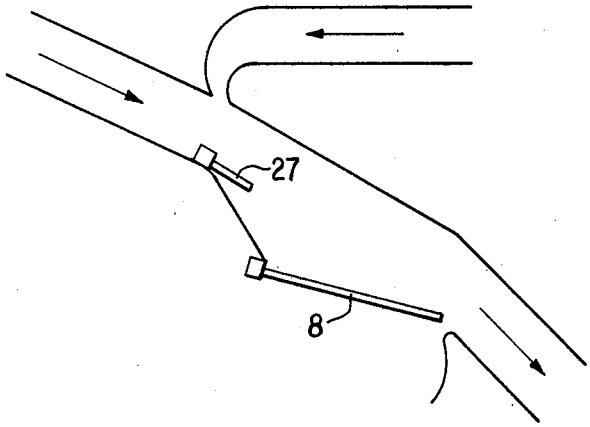
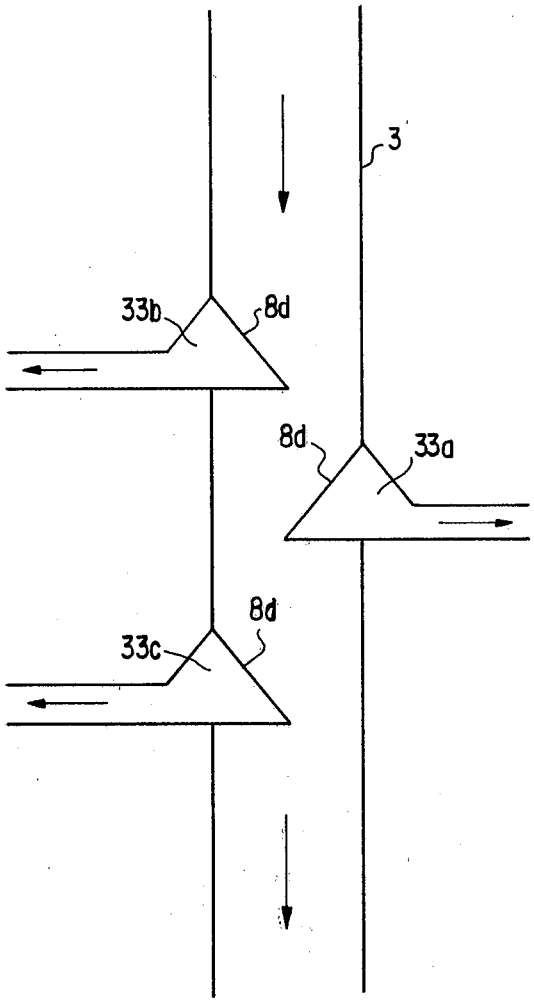
FIG. 7

APPARATUS FOR CLEANING TEXTILE FIBER TUFTS

BACKGROUND OF THE INVENTION

The present invention relates to an apparatus for cleaning and removing dust from textile fiber tufts, the apparatus being of the type which includes a pipeline in which an injector nozzle is provided, an associated air separation zone spaced from the injector nozzle and having an opening, and an apparatus for extracting the air.

In a prior art device, fiber tufts are introduced into a stream of air exiting from an injector nozzle and the resulting deflection as well as the turbulent flow of air created by the injector nozzle removes shell remnants and other foreign bodies from the tufts. The air mixed with the fiber tufts is then immediately forced through a further conically tapered cleaning nozzle and upon leaving this nozzle the suddenly widened cross section of the air stream creates a further turbulent flow which causes the bunches of fibers to be opened further. Then the fiber tufts are brought past a wire screen through which the pressurized air escapes while carrying away the foreign bodies released by the fiber tufts. The wire screen is attached, after several bends, to the end of the pipeline. This apparatus is unduly complicated and not suitable to effect extensive release of dust from the fiber tufts. Another drawback is that the wire screen may be clogged with fiber tufts.

SUMMARY OF THE INVENTION

It is therefore an object of the present invention to provide an apparatus which achieves extensive release of dust and avoids clogging of the air discharge zone.

This and other objects are achieved, according to the invention, in apparatus for cleaning and removing dust from textile fiber tufts, which apparatus includes means defining a channel for the passage of fiber tufts and including an air injector nozzle for introducing air into the channel, means defining an air separation zone having apertures and associated with the channel for separating air from the tufts in the channel, and means for extracting air from the air separation zone, by constituting the means defining an air separation zone of at least one comb disposed a short distance downstream of the injector nozzle at a location to enable tufts being carried through the channel to abut on the comb.

According to further embodiments of the invention, the channel is provided with at least one abutment element disposed so that at least some of the tufts impact thereon before reaching the comb.

Due to the fact that the air discharge zone is provided with at least one comb, the fiber tufts are able to slide along the comb. This prevents clogging of the interstices between the teeth of the comb, additionally producing a self-cleaning effect for the comb teeth. It is significant for the present invention that the textile fiber tufts abut on the comb, thus effectively releasing dust from the tufts. The apparatus operates according to the principle of mixing fresh air with the stream of dust laden textile fiber tufts and simultaneous extraction of dust laden air. An injector effect is created at the point where the injector air blows in. In the injector, the fiber tufts are accelerated and driven in the direction toward the combs. The air exit side of the combs is subjected to a suction action and the dust laden air extracted there is conducted through a filter. The impingement of the textile fiber tufts on combs permits, in a structurally simple manner, extensive removal of dust without the occurrence of clogging of the combs since the tufts, which are driven by the stream of air, slide along the teeth of the combs.

Preferably, at least one comb is disposed in the path of the stream of air exiting the injector nozzle. Advisably the distance between adjacent teeth of the comb is about 1 to 3 mm. Preferably a plurality of combs are arranged in a group one behind the other downstream of the injector nozzle. According to a further preferred embodiment, the combs are arranged at an angle to one another. Advisably, the combs are arranged to each be pivotal about an axis. According to a further, particularly preferred, embodiment the textile fiber tufts, after impinging on the comb, are conducted through at least one further injector nozzle with an associated comb or comb group.

Preferably the suction device is associated with the air exit side of the combs. Advisably the suction device is provided with a filter and the suction chamber is designed as a door. Preferably the end of the pipeline is followed by a condenser.

According to a further, advantageous, embodiment, the air separation zone narrows in the direction of flow. Advantageously the air separation zone is composed in part of combs which are oriented in the direction of the stream of air. Preferably the walls of the air separation zone are designed at least in part to act as combs. Advisably fresh air is blown in through the injector nozzle.

In further accordance with the invention, dust and waste release and removal are enhanced by the provision of an abutment element disposed in the vicinity of the upstream, or inlet, end of the comb, preferably in the path of the stream of air from the injector nozzle so that fiber tufts can strike this element, thus causing the fiber tufts to be loosened. In this way dust and waste are released from the fiber tufts. Thereafter the dust and waste are removed through the associated comb.

Preferably, the abutment element is disposed above the comb so that the tufts go from the abutment element to the comb while brushing along the pins, teeth or the like, of the comb and those teeth are cleaned by the accompanying air streams. Advisably the abutment element presents an abutment surface which is oriented at an angle to the comb so that the abutment surface can impart a defined direction of travel to the tufts. The abutment element may be a plate or perforated metal sheet.

Preferably, the abutment element is in the form of a grating composed of relatively strong rods which are able to withstand heavy impacts. The longitudinal slots between the grating rods may have such a width that part of the fiber tufts can pass through these slots, while another part will slide off of the grating rods which are preferably open at the bottom, or downstream end, of the element. The slots produce a slight air resistance with respect to the approaching mixture of fiber tufts and air.

The abutment element may also be in the form of a comb which has small slits of a width which is less than the size of the tufts. The associated further comb downstream of the abutment element separates the fiber tufts from the dust.

According to a particularly preferred embodiment, the comb which follows the abutment element is followed by a region of lower air pressure so that the dust and the waste which has been removed from the tufts can be sucked off.

According to a further, preferred embodiment, the comb is composed of two mutually parallel comb elements between which pass the fiber tufts. Outside of the comb elements, injector nozzles with downwardly oriented apertures are arranged spaced from one another so as to successively drive the fiber tufts from one comb to the other. The gravity effect with which the fiber tufts drop through the channel is here amplified by the injector nozzles. Advisably an abutment element is provided within the two comb elements in the vicinity of the injector nozzle.

BRIEF DESCRIPTION OF THE DRAWINGS

FIGS. 4 and 5 are detail cross-sectional elevational views of modified versions of the apparatus of FIG. 3.

FIG. 6 is a view similar to that of FIG. 5 showing a modified form of construction of the embodiment of FIG. 5.

FIG. 7 is a detail, cross-sectional view of another embodiment of apparatus according to the invention.

DESCRIPTION OF THE PREFERRED EMBODIMENTS

Figure 1:
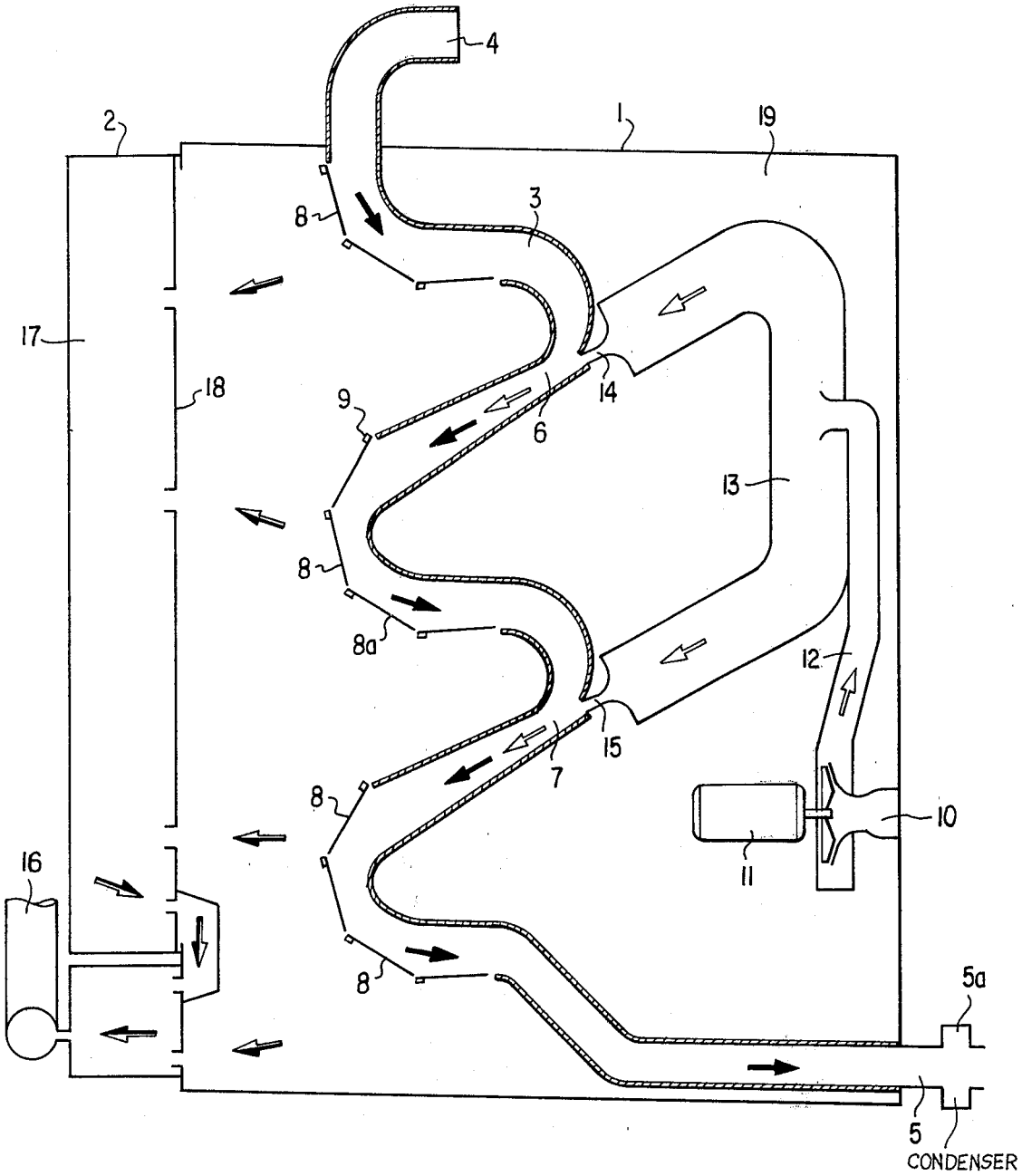
FIG. 1 is a simplified, pictorial, cross-sectional side view of an apparatus according to a preferred embodiment of the invention for cleaning and removing dust from textile fiber tufts.

The apparatus shown in FIG. 1 includes a closed housing 1 having a door 2 and enclosing a meander-shaped, or serpentine, channel and comb system 3. Textile fiber tufts are introduced into system 3 through an entrance 4 disposed in the vicinity of the top wall of housing 1 and removed therefrom through an exit 5 disposed at the lower end of one side wall of the housing. The channel and comb system 3 is subjected to suction applied via exit 5 and a condenser 5*a*. The condenser can be of a known type which effects further cleaning of the tufts and then delivers them for further processing. The mass air flow for transporting the fiber tufts is set, for example, to about 3400 $m^3/h$.

An injector nozzle 6 or 7 is provided at each of two locations in the channel and comb system 3. Three combs 8 are disposed along the outer lateral side of the first bend following entrance 4 and four combs 8 are arranged one behind the other along the outer lateral side of each of the bends following a respective one of the injector nozzles 6 and 7.

The parallel teeth of the combs 8 may be constructed as disclosed in German Auslegeschrift [Published Patent Application] No. 1,286,436 and are oriented in the direction of the stream of air which acts to transport the textile fiber tufts. The combs 8 of each group are arranged at an angle to one another and are each pivotable about a respective axis 9. It is significant that at least one comb 8 is disposed in the path of the stream of air exiting from each injector nozzle 6 or 7 to cause the textile fiber tufts to abut directly thereon.

A blower 11 with a suction power of about 2500 $m^3/h$ sucks fresh air from the outside of the housing 1 through an air inlet 10 and propels it through a pipeline 12 into a distributor conduit, or plenum, 13. The distributor conduit 13 is provided with two constrictions 14 and 15 through which the fresh air enters into the injector nozzles 6 and 7, respectively. At each point of entry, i.e. at the outlet of each constriction 14 or 15, a stream of fresh air enters into the dust laden stream of fiber tufts, accelerates the fiber tufts and drives them in the direction toward the combs 8. At the combs 8, part of the air exits and carries along the dust released from the fiber tufts upon impact with the combs. The other part of the air continues to transport the tufts further through the channel and comb system 3.

The air exit side of the combs 8 is subjected to suction. For this purpose a ventilator or blower (not shown) having a suction power of about 2500 $m^3/h$ is provided outside of the housing and is connected with the interior of the housing 1 via a conduit 16 fastened to the door 2. The interior 17 of the door 2 defines a suction chamber separated from the interior 19 of the housing 1 by a filter 18. Dust laden air exiting from the combs 8 on the air exit side thereof thus reaches the filter 18 where the dust is collected so that clean air is extracted through conduit 16. Door interior 17 is divided into two parts separated by a partition and communicating via a passage extending around the partition for guiding air which has passed through filter 18 to conduit 16.

Figure 2:
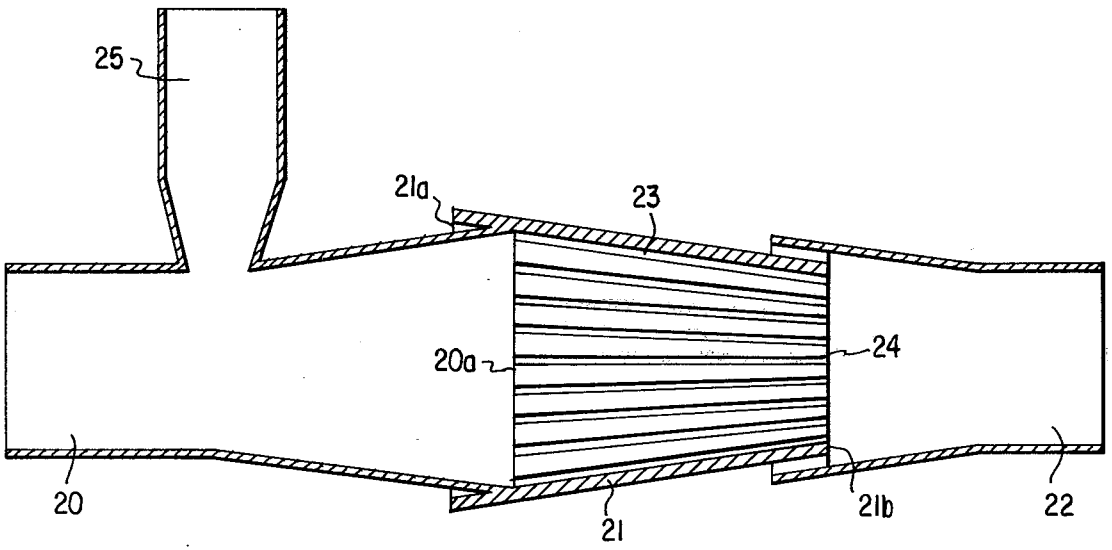
FIG. 2 is a cross-sectional detail view of a modified version of a component of the apparatus of FIG. 1.

FIG. 2 shows a particular form of construction for an injector nozzle 20 having an outlet 20*a* which conically widens in the direction of flow and extends into the inlet 21*a* of an intermediate piece 21. The intermediate piece 21 conically narrows in the direction of flow, its outlet 21*b* extending into the inlet of a channel 22. The intermediate piece 21 is a conical pipe which is provided with slit-like apertures 23 over its entire length so that the pipe itself is in the form of an array of rods 24. According to the invention, the rods 24 of the intermediate piece 21 become narrower in the direction of flow, so as to cause the slit-like apertures 23 between rods to be of constant width, i.e. the distance between two adjacent rods 24 is the same everywhere. Due to the fact that the slit-shaped apertures do not become narrower, no fiber tufts can be caught therein. When the structure of FIG. 2 is used in the apparatus of FIG. 1, the fiber flow channel includes a conduit 25 via which fibers flow into nozzle 20. The channel 3 has a width of 1 mm and a middle average of about 100 mm. The comb 8*a* of FIG. 1 may be the same of the combs 8.

Figure 3:
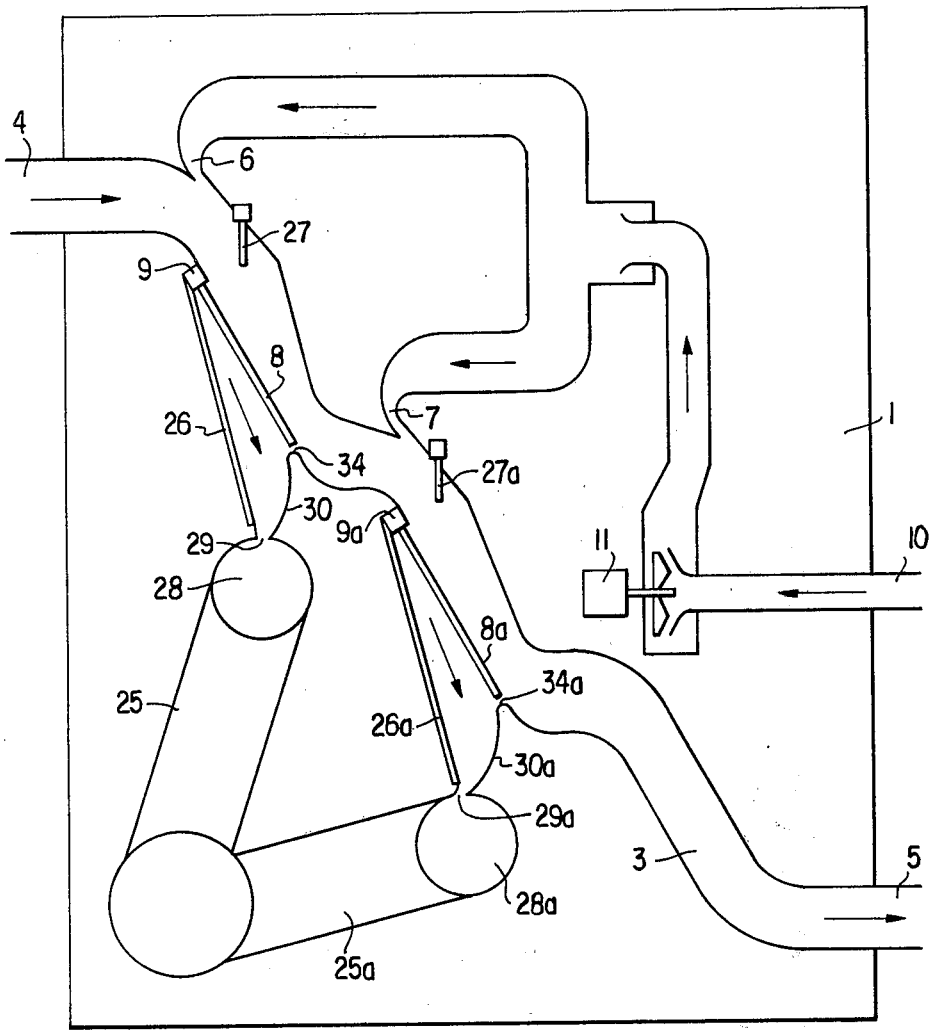
FIG. 3 is a view similar to that of FIG. 1 of another embodiment of apparatus according to the invention.

In the apparatus shown in FIG. 3, as in that of FIG. 1, entrance 4 may be connected to the pressure side of a ventilator (not shown) and the exit 5 to the suction side of a ventilator or to a condenser (not shown). In one wall of the channel system 3 two combs 8 and 8*a* are arranged one above the other and each opposite, and downstream of, a respective one of the injector nozzles 6 and 7. The parallel teeth of the combs 8 and 8*a*, which may have the same form as those of the combs of FIG. 1, are oriented in the direction of the stream of fiber tufts.

The combs 8 and 8*a* are each rotatable about a respective axis 9 or 9*a*. The teeth of each comb 8 and 8*a* have a diameter of, for example, 6 mm and the gap between the teeth of the combs 8 and 8*a* is, for example, 2 mm. At the suction side of the combs 8 and 8*a*, suction hoods 28 and 28*a*, respectively, and suction lines 25 and 25*a*, respectively, are connected in direct proximity to the combs to remove dust and waste. At the suction side of each of the combs 8 and 8*a* there is further disposed a respective control window 26 or 26*a*.

Within the system 3 and above each comb 8 and 8*a* there is provided a respective grate 27 or 27*a* constituting an abutment element. Each grate 27 and 27*a* is made up of rods having a diameter of, for example, 10 mm and the gap between the rods is, for example, 10 mm. Each grate 27 and 27*a* is arranged at an acute angle to its associated comb 8 or 8*a*.

Ventilator 11 having a suction power of about 2500 $m^3/h$ sucks fresh air from the outside of housing 1 through air inlet 10 and feeds it to injectors 6 and 7. At the points of entry defined by injectors 6 and 7, the stream of fresh air enters into the stream of fiber tufts containing dust and waste, accelerates the fiber tufts and drives them in the direction toward the respective grates 27 or 27*a*. When the fiber tufts impact on the rods of a grate 27 or 27*a*, dust and waste are released. Part of the fiber tufts passes through the gaps between the rods of the grate and the other part of the fiber tufts slides downwardly along these rods. Thereafter, part of the fiber tufts slides downwardly along the comb 8 or 8*a* and the other part flows downwardly directly through channel 3.

The dust laden air is removed through the gaps between the teeth of combs 8 and 8*a*. For this purpose, there are provided the suction hoods 28 and 28*a* which are equipped with respective longitudinal slots 29 and 29*a* and respective metal guide sheets 30 and 30*a*. The dust laden air passes through lines 25 and 25*a* onto, e.g. filters (not shown). Thus the suction is applied directly and positively against the air exit side of the combs 8, 8*a*.

Each metal guide sheet 30 or 30*a* together with the inner wall of the channel system 3 adjacent thereto forms a knife edge 34 or 34*a* which is disposed opposite the lower, or downstream, end of the associated comb 8 or 8*a*. In this way, the streams of air in front of and behind the combs 8 and 8*a* slide along the teeth of the combs and flow along the guide sheets 30 and 30*a*, without any interference and turbulence formation, into the suction hood 28 and 28*a*, on the one hand, and along the inner wall of the channel system 3, on the other hand. In this way it is avoided that fiber tufts may be caught at the lower end of the teeth of the combs 8, 8*a* and the teeth are cleaned by the streams of air.

Figure 3A:
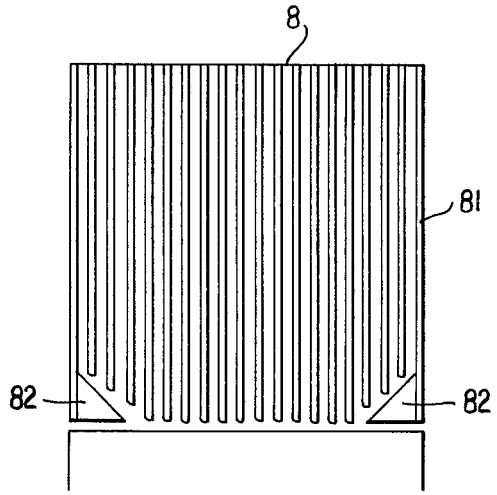
FIG. 3*a* is a detail front view of the structure of each comb of FIG. 3 or of FIG. 1.

FIG. 3*a* shows a front view of the teeth of the comb 8, which are identical to those of comb 8*a*. At the lower end of the laterally outermost teeth 81, triangular pieces 82 are attached via one of their short sides, while the ends of adjacent teeth 81 conform to the hypotenuse of the associated piece 82. The teeth 81 in the edge region of the comb are thus shorter than the teeth 81 in the center region thereof. This form of construction prevents formation of a hollow corner in the edge region in which the fiber tufts could be caught.

Figure 4:
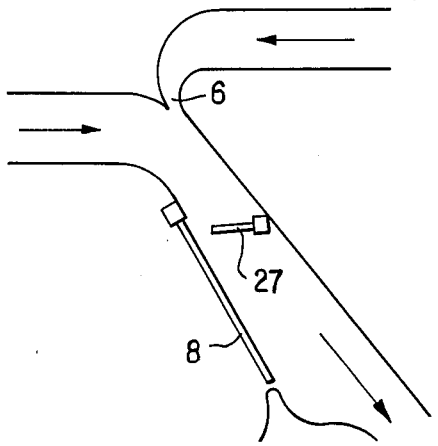

In the embodiment represented in FIG. 4, the grate 27 is arranged at an obtuse angle with respect to comb 8. A strong impact of the textile fiber tufts, which are accelerated by the injector nozzle 6, is realized in that a large grate area is thus made available by grate 27.

FIG. 5 shows an embodiment in which the grate 27 is disposed on the same side of the channel as the comb 8. Due to the position of grate 27 above the comb 8, dust laden air and waste released by impact on the grate can be removed through the comb disposed directly therebelow. The grate 27 is arranged at an acute angle with respect to comb 8.

In the modified arrangement shown in FIG. 6, the grate 27 is arranged at an obtuse angle with respect to comb 8. The angle between the grate 27 and the comb 8 is e.g. in FIG. 3 130°, in FIG. 4 70° and in FIG. 6 150°.

FIG. 7 shows a detail of an embodiment of apparatus in which combs 8*d* are fastened at successive locations along channel 3 and are laterally staggered so that successive combs are disposed on opposite inner walls of the channel system 3. On the side of the combs 8*d* facing away from the fiber tufts, extraction devices 33*a*, 33*b* and 33*c*, respectively, are provided. A blower (not shown), e.g. a fan, conveys the fiber tufts through the channel system 3 and the stream of air causes them to abut on the combs 8*d*.

The angle between each comb 8*d* and the inner walls of the channel system 3 is e.g. 130°.

The windows 26 and 26*a* of FIG. 3 serve for visual control especially of the controls.

Figure 3B:
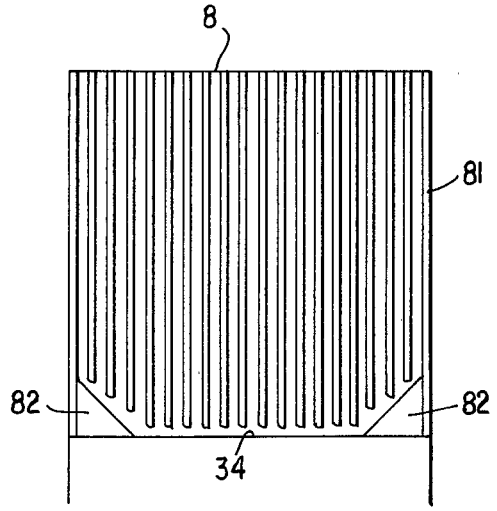
FIG. 3*b* is a detail front view of another structure of each comb of FIG. 3.

FIG. 3*b* shows a front view of the teeth of the comb 8, which are identical to those of comb 8*a*. At the lower end of the laterally outermost teeth 81, triangular pieces 82 are attached via one of their short sides, while the ends of adjacent teeth 81 conform to the hypotenuse of the associated piece 82. The other short side of the triangular pieces 82 is directly attached on the knife edge 34. The teeth 81 in the edge region of the comb are thus shorter than the teeth 81 in the center region thereof. This form of construction prevents formation of a hollow corner in the edge region in which the fiber tufts could be caught.

It will be understood that the above description of the present invention is susceptible to various modifications, changes and adaptations, and the same are intended to be comprehended within the meaning and range of equivalents of the appended claims.

What is claimed is:

1. Apparatus for cleaning and removing dust from textile fiber tufts, comprising means defining a channel for the passage of fiber tufts and including an air injector nozzle for introducing fresh air into the channel, means defining an air separation zone associated with the channel for separating air from the tufts in the channel, and suction means for extracting air from the air separation zone, wherein said means defining an air separation zone comprise at least one comb disposed a short distance downstream of said injector nozzle at a location to enable tufts being carried through said channel to abut on said comb, said comb being composed of a plurality of teeth extending generally in the direction of flow of the stream of air introduced by said nozzle.

2. Apparatus as defined in claim 1 wherein said comb extends across the path of air flow generated by said injector nozzle.

3. Apparatus as defined in claim 1 wherein said comb is composed of a plurality of teeth having a mutual spacing of about 1 to 3 mm.

4. Apparatus as defined in claim 1 wherein said means defining an air separation zone comprise a plurality of said combs arranged one behind the other along said channel.

5. Apparatus as defined in claim 4 wherein said combs are oriented at an angle to one another.

6. Apparatus as defined in claim 5 further comprising means supporting each said comb for pivotal movement about an axis relative to said channel.

7. Apparatus as defined in claim 1 further comprising at least one further injector nozzle mounted for introducing air into said channel downstream of said first-recited nozzle, and at least one second comb disposed a short distance downstream of said further nozzle at a location to enable tufts being carried through said channel to abut on said second comb.

8. Apparatus as defined in claim 1 wherein said extraction means are associated with the side of said comb directed away from said channel.

9. Apparatus as defined in claim 1 wherein said extraction means comprise an air filter.

10. Apparatus as defined in claim 1 further comprising a housing enclosing said channel and provided at one side with a door, and wherein said air extracting means comprise a suction chamber enclosed by said door.

11. Apparatus as defined in claim 1 further comprising a condenser disposed at the outlet end of said channel.

12. Apparatus as defined in claim 1 wherein said means defining an air separation zone presents a region which becomes progressively narrower in the direction of air flow in said channel.

13. Apparatus as defined in claim 12 wherein said region of said air separation zone is composed of a plurality of rods extending in the direction of air flow in said channel.

14. Apparatus as defined in claim 12 wherein said region of said air separation zone comprises a wall having the form of a comb.

15. Apparatus as defined in claim 14 wherein said wall in the form of a comb is constituted by a plurality of rods which narrow progressively in the direction of air flow in said channel to define slit-shaped apertures located between said rods and having a constant width along the air flow direction.

16. Apparatus as defined in claim 1 further comprising means for blowing fresh air into said channel through said injector nozzle.

17. Apparatus as defined in claim 1 wherein said air extracting means operate to create a region of low air pressure directly adjacent the side of said comb directed away from said channel.

18. Apparatus as defined in claim 17 wherein said air extracting means comprise a suction hood enclosing at least part of said region.

19. Apparatus as defined in claim 1 further comprising a metal guide sheet forming a cutting edge with a side of said channel and disposed opposite the downstream end of said comb.

20. Apparatus as defined in claim 1 wherein said comb is provided with a plurality of parallel teeth extending generally in the direction of air flow in said channel, with the teeth in the vicinity of the lateral edges of said comb being shorter than those at the center of said comb, and said comb further includes two members located opposite said teeth which are in the vicinity of said lateral edges of said comb, each said member presenting a sloping surface parallel to the ends of said teeth which are opposite thereto.

21. Apparatus as defined in claim 1, 17, 18, 19 or 20 wherein said comb extends along said channel and further comprising at least one abutment element within said channel in the vicinity of the upstream end of said comb.

22. Apparatus as defined in claim 21 wherein said abutment element is disposed above said comb.

23. Apparatus as defined in claim 21 wherein said abutment element extends at an angle with respect to said comb.

24. Apparatus as defined in claim 23 wherein said abutment element is constituted by a grate.

25. Apparatus as defined in claim 23 wherein said abutment element is constituted by a comb.

26. Apparatus as defined in claim 1 wherein said channel has an inlet end for receiving the fiber tufts and said nozzle is positioned for introducing air into said channel at a location downstream of said inlet end.

27. Apparatus for cleaning and removing dust from textile fiber tufts, comprising means defining a channel for the passage of fiber tufts, means for blowing a stream of air into the channel, means defining an air separation zone having apertures and associated with the channel for separating air from the tufts in the channel, and suction means for extracting air from the air separation zone, wherein said means defining an air separation zone comprise at least one separation element presenting such apertures and extending along said channel, and at least one abutment element positioned within said channel in the vicinity of the upstream end of said separation element for permitting fiber tufts conveyed by the air stream in said channel to impact against said abutment element.

28. Apparatus as defined in claim 27 wherein said separation element is constituted by a comb composed of a plurality of teeth extending generally in the direction of flow of the stream of air in said channel and said abutment element is disposed above said comb.

29. Apparatus as defined in claim 28 wherein said abutment element extends at an angle with respect to said comb.

30. Apparatus as defined in claim 27, 28 or 29 wherein said abutment element is constituted by a grate.

31. Apparatus as defined in claim 27, 28 or 29 wherein said abutment element is constituted by a comb.

32. Apparatus as defined in claim 27 wherein said air extracting means operate to create a region of low air pressure directly adjacent the side of said separation element directed away from said channel.

33. Apparatus as defined in claim 32 wherein said air extracting means comprise a suction hood enclosing at least part of said region.

34. Apparatus as defined in claim 27 further comprising a metal guide sheet forming a cutting edge with a side of said channel and disposed opposite the downstream end of said separation element.

35. Apparatus as defined in claim 27 wherein said separation element is in the form of a comb provided with a plurality of parallel teeth extending generally in the direction of air flow in said channel, with the teeth in the vicinity of the lateral edges of said comb being shorter than those at the center of said comb, and said comb further includes two members located opposite said teeth which are in the vicinity of said lateral edges of said comb, each said member presenting a sloping surface parallel to the ends of said teeth which are opposite thereto.

* * * * *

UNITED STATES PATENT AND TRADEMARK OFFICE

CERTIFICATE OF CORRECTION

PATENT NO. : 4,365,389

DATED : December 28, 1982

INVENTOR(S) : Wolfgang Beneke et al

It is certified that error appears in the above—identified patent and that said Letters Patent is hereby corrected as shown below:

On the title page, under [30] after "Foreign Application Priority Data", the first priority date claimed should read --Sep. 29, 1979--.

Column 4, line 50, "1 mm" should read --1 m--.

Signed and Sealed this

*Twenty-sixth* Day of *July 1983*.

[SEAL]

*Attest:*

GERALD J. MOSSINGHOFF

*Attesting Officer*

*Commissioner of Patents and Trademarks*